United States Patent [19]

Schnur et al.

[11] Patent Number: 4,519,932

[45] Date of Patent: May 28, 1985

[54] LOW TEMPERATURE HYDRAULIC FLUIDS BASED ON TWO CENTISTOKE SYNTHETIC HYDROCARBONS

[75] Inventors: Nicholas E. Schnur, Cincinnati, Ohio; Bruce J. Beimesch, Crescent Springs, Ky.

[73] Assignee: National Distillers and Chemical Corporation, New York, N.Y.

[21] Appl. No.: 532,879

[22] Filed: Sep. 16, 1983

Related U.S. Application Data

[63] Continuation-in-part of Ser. No. 419,897, Sep. 20, 1982, abandoned.

[51] Int. Cl.[3] ..... C10M 3/12; C10M 3/20; C07C 2/74

[52] U.S. Cl. ..... 252/73; 252/56 D; 252/56 S; 252/77; 252/78.1; 252/78.5; 252/79; 585/10; 585/255

[58] Field of Search ..... 252/56 D, 56 S, 73, 252/77, 78.1, 78.5, 79; 585/10, 255

[56] References Cited

U.S. PATENT DOCUMENTS

| | | | |
|---|---|---|---|
| 3,629,114 | 12/1971 | Fairing | 252/78.5 |
| 3,763,244 | 10/1973 | Shubkin | 585/255 |
| 3,791,976 | 2/1974 | Messina et al. | 252/78.5 |
| 4,032,591 | 6/1977 | Cupples et al. | 252/73 |
| 4,144,183 | 3/1979 | Koch et al. | 252/79 |

OTHER PUBLICATIONS

Smalheer et al., *Lubricant Additives,* Cleveland, The Lezius-Hiles Co., 1967, p. 7.

*Primary Examiner*—Paul Lieberman
*Assistant Examiner*—Robert A. Wax
*Attorney, Agent, or Firm*—Kenneth D. Tremain; Gerald A. Baracka

[57] ABSTRACT

Useful hydraulic fluids having low temperature properties comparable to MIL-H-5606 fluids but exhibiting markedly superior fire resistance due to their higher flash points are obtained by blending a two centistoke synthetic hydrocarbon oil obtained from the oligomerization of alpha-olefins with a mono- or diester and polymethacrylate viscosity index improver. The fluids of this invention typically have −65° F. viscosities less than 3000 centistokes, 210° F. viscosities of 3.45 or above, and flash points above 320° F. and are readily formulated with conventional additives.

9 Claims, No Drawings

LOW TEMPERATURE HYDRAULIC FLUIDS BASED ON TWO CENTISTOKE SYNTHETIC HYDROCARBONS

CROSS-REFERENCE TO RELATED APPLICATION

This is a continuation-in-part of copending application Ser. No. 419,897, filed Sept. 20, 1982, now abandoned.

BACKGROUND OF THE INVENTION

1. Field of the Invention

This invention relates to improved low temperature synthetic hydraulic fluids comprised of a 2 centistoke hydrogenated alpha-olefin oligomer, an ester or mixture of esters, and a viscosity index improver, said ester(s) and viscosity index improver selected to impart specific characteristics to the fluid which may also contain other conventional additives.

2. Description of the Prior Art

Military specifications for petroleum based hydraulic fluids designed for use in the −65° F. to 160° F. temperature range are defined by MIL-H-5606. These fluids give the military acceptable low temperature operating capabilities, however, due to their high volatility and relatively low flash point (179.6° F. minimum) these fluids present a substantial fire hazard and therefore are not suitable for use in many applications.

As a result of the flammability problems associated with the MIL-H-5606 fluids, more fire-resistant hydraulic fluids have been developed and are specified in MIL-H-83282. MIL-H-83282 fluids are based on 4 centistoke synthetic hydrocarbon base stocks and have significantly higher flash points (400° F. minimum). This is not, however, accomplished without some sacrifice of low temperature properties. MIL-H-83282B fluids are recommended for use only to −40° F.

It would be highly desirable if hydraulic fluids having the −65° F. capabilities of the MIL-H-5606 fluids and exhibiting the substantially improved fire resistance of MIL-H-83282 fluids were available. It would be even more advantageous if such fluids were based on readily available and economical 2 centistoke synthetic hydrocarbon basestock obtained from an alpha-olefin oligomerization process and if the products possessed all of the other properties necessary for commercial hydraulic fluids.

The low molecular weight fraction obtained from alpha-olefin oligomerization processes, which is comprised primarily of dimer and has a 210° F. viscosity of about 2 centistokes, is generally considered to be unsuitable for most lubrication applications. Therefore, in most oligomerization processes the oligomeric product is fractionated to remove any unreacted olefin and the olefin dimers (see for example U.S. Pat. Nos. 3,907,924, 4,175,046 and 4,282,392). The fraction(s) which contain predominantly trimer and/or tetramer oligomers and which typically have 210° F. viscosities in the 4 to 6 centistoke range are then utilized for commercial and industrial uses.

It is known to blend certain esters with the higher oligomers of alpha-olefins (trimer and tetramer) to obtain useful synthetic oils. For example, in U.S. Pat. No. 4,175,046 to Coant et al. compositions useful as lubricants for marine and industrial diesel engines and comprised of a mixture of esters and a hydrogenated alpha-olefin oligomer are described. The hydrogenated oligomers employed by Coant et al. typically have 210° F. viscosities of about 6 centistokes and the use of viscosity index improvers is expressly prohibited. Two centistoke alpha-olefin oligomers would not be acceptable for use in the formulations of U.S. Pat. No. 4,175,046 since products totally unsuitable for use as engine oils would be obtained.

In view of the limited number of applications heretofore developed for the 2 centistoke fraction, efforts to recycle olefin dimers in the oligomerization process to further react the dimer with additional alpha-olefin have been made but have not been entirely successful. This is due primarily to the significantly reduced reactivity of the dimer. It has thus been suggested for some commercial operations that the most economical means of disposing of the 2 centistoke fraction is to burn the product for its fuel value. It would be highly desirable if useful lubricant compositions based on 2 centistoke alpha-olefin oligomers were available.

SUMMARY OF THE INVENTION

We have now quite unexpectedly discovered that highly useful hydraulic fluids, preferably having low temperature properties comparable to that of the MIL-H-5606 fluids and fire resistance comparable to that of the MIL-H-83282 fluids, are obtained utilizing a 2 centistoke synthetic hydrocarbon obtained from the oligomerization of an alpha-olefin. In addition to the 2 centistoke hydrogenated alpha-olefin oligomer, the improved fluids of the invention also contain an ester or mixture of esters, a viscosity index improver and, optionally, other conventional lubricant additives such as antioxidants, antiwear/EP additives, corrosion inhibitors, and the like. For this invention, the esters and viscosity index improvers are selected in such a manner as to impart the desired viscosity, flashpoint, shear stability, and rubber swell to the finished hydraulic fluid.

The hydraulic fluids of the present invention which exhibit improved low temperature properties and fire resistance are obtained by blending 30 to 90 percent by weight of a synthetic hydrocarbon obtained from the oligomerization of a $C_{6-12}$ alpha-olefin or alpha-olefin mixture and having a 210° F. viscosity of 1.6 to 2.2 centistokes; 5 to 50 percent by weight of a monoester or diester containing from 13 to 30 carbon atoms; and 5 to 20 by weight percent of a polymethacrylate viscosity index improver. Useful mono- or diesters for the invention have 210° F. viscosities of 3.5 centistokes or less and −65° F. viscosities of less than 8000 centistokes. The polymethacrylate viscosity index improvers should be capable of developing a viscosity index in the formulated hydraulic fluid of 210 or more and must not destroy the homogeneity of the fluid at −65° F. or cause the fluid to gel or freeze at −65° F.

The hydraulic fluids are further characterized by having 210° F. viscosities $\geqq 3.45$ centistokes, −65° F. viscosities $<3000$ centistokes and flashpoints $\geqq 320°$ F. In an especially useful embodiment of this invention, from 40 to 75 percent by weight synthetic hydrocarbon is employed with 6 to 12 weight percent of the viscosity index improver and either 20 to 30 weight percent di-2-ethylhexyl adipate or di-2-ethylhexyl azelate or 40 to 50 weight percent 2-ethylhexyl pelargonate or isodecyl pelargonate. Preferred polymethacrylate viscosity index improvers have weight average molecular weights in the range 40,000 to 65,000 and intrinsic viscosities of 0.040 to 0.065.

DETAILED DESCRIPTION OF THE INVENTION

In accordance with this invention, improved low temperature hydraulic fluids based on 2 centistoke synthetic hydrocarbons obtained from the oligomerization of alpha-olefins are provided. Processes for the production of oligomers from alpha-olefins are well known and any of the conventional cationic polymerization procedures may be employed to obtain the 2 centistoke synthetic hydrocarbon. Such techniques are described in the literature and by way of illustration reference may be had to U.S. Pat. Nos. 3,149,178, 3,763,244 and 3,780,128. These processes describe the batch oligomerization of alpha-olefins, such as 1-decene, using a boron trifluoride catalyst in combination with a promoter such as an alcohol or water. Dimer, trimer, tetramer and higher oligomers are formed in these processes and the dimer and any unreacted alpha-olefin are separated from the higher oligomers by fractional distillation. The higher oligomeric product consisting of trimer, tetramer, pentamer and minor amounts of higher oligomers is then hydrogenated to improve the oxidative stability. In addition to the aforementioned batch type procedures, continuous oligomerization processes have been developed and are described in U.S. Pat. Nos. 4,045,508 and 4,239,920. Dimerization processes whereby 2 centistoke fluids are produced directly and as the major product are also known.

The 2 centistoke synthetic hydrocarbon employed for the preparation of the improved hydraulic fluids of this invention consists predominantly of dimeric products derived from 1-decene or an alpha-olefin mixture containing a major proportion of 1-decene. Other alpha-olefins which can be present in minor amounts can have from about 6 to 12 carbon atoms but are primarily 1-octene and 1-dodecene. Preferably the 2 centistoke fluid will be derived from alpha-olefins containing at least 75 percent by weight 1-decene and synthetic hydrocarbons derived from alpha-olefins containing 90 percent by weight or more 1-decene are particularly advantageous. The dimer fraction, obtained by oligomerization of the above described alpha-olefins and fractionally distilled from the higher oligomeric moieties, will contain less than 25 percent and, more preferably, less than 10 percent trimer and higher oligomers.

The dimer is hydrogenated prior to use so that it is essentially saturated. This can be accomplished either before fractionation from the higher oligomers or the dimer can be hydrogenated subsequent to fractionation. Synthetic dimeric hydrocarbon fluids of the above types will have 210° F. viscosities in the range 1.6 to 2.2 centistokes. The −65° F. viscosity of such synthetic hydrocarbon products will typically be less than 2000 centistokes.

The synthetic hydrocarbon can constitute from 30 to 90 percent by weight of the formulated hydraulic fluid, however, most generally, the 2 centistoke synthetic hydrocarbon will be present in the range 40 to 75 percent by weight.

To obtain the improved hydraulic fluids of this invention, one or more synthetic esters is employed with the above-described 2 centistoke alpha-olefin oligomers. Useful esters for this purpose have 210° F. viscosities less than 3.5 centistokes and −65° F. viscosities less than 8000 centistokes. In general, esters having the above characteristics will contain from 13 to 30 carbon atoms and are diesters or simple esters (monoesters) respectively obtained by (a) the reaction of a dicarboxylic acid with a monofunctional alcohol or (b) the reaction of a monocarboxylic acid and monofunctional alcohol. These esters will typically have acid values less than three and, more preferably, less than one.

More particularly, diesters of the type (a) will be derived from aliphatic dicarboxylic acids having from 6 to 9 carbon atoms with adipic acid and azelaic acid being particularly useful. Alcohols reacted with the dicarboxylic acid are aliphatic branched-chain alcohols having from 6 to 10 carbon atoms. $C_8$ alcohols and particularly 2-ethylhexanol are particularly useful. Monoesters of the type (b) are derived from $C_{7-18}$ aliphatic monocarboxylic acids and aliphatic branched-chain alcohols having from 8 to 12 carbon atoms. Particularly useful esters of the latter type are derived from $C_{9-12}$ aliphatic monocarboxylic acids and a $C_{10}$ aliphatic branched-chain alcohol, e.g. isodecyl alcohol obtained from an oxo process.

The type and amount of ester is chosen to complement the properties of the 2 centistoke synthetic hydrocarbon. For example, since the synthetic hydrocarbon has a tendency to shrink certain rubber gaskets and seals commonly used in hydraulic pumps, the synthetic ester must be able to counterbalance that shrinkage if an acceptable hydraulic fluid is to be obtained. A similar balance must be achieved to obtain the other desired properties in the finished fluid. In general, the ester constitutes from about 5 to 50 and, more usually, 20 to 50 weight percent of the formulated hydraulic fluid. Formulations obtained utilizing di-2-ethylhexyl adipate or di-2-ethylhexyl azelate in an amount from 20 to 30 percent by weight and 2-ethylhexyl pelargonate or isodecyl pelargonate in an amount from 40 to 50 percent by weight are particularly advantageous.

In addition to the above-defined simple ester and diester products, other esters may also be utilized. For example, polyol esters obtained by the reaction of a polyol, such as neopentyl glycol or trimethylolpropane, with aliphatic monocarboxylic acid having from about 5 to 10 carbon atoms can be employed. Such esters can be used in conjunction with the mono- or diester or can be utilized as the sole ester component.

A viscosity index (VI) improver is an essential component of the improved hydraulic fluids of this invention. The VI improver is selected based on its ability to satisfy the shear stability and viscosity index requirements of the finished fluid. This is accomplished by the use of polymethacrylate VI improvers wherein the polymethacrylate polymer has a weight average molecular weight in the range 40,000 to 65,000 and, more preferably, 45,000 to 60,000 and intrinsic viscosity of 0.040 to 0.065 and more preferably, 0.045 to 0.060. As used herein, weight average molecular weight refers to the weight average molecular weight of the polymer portion of the VI improver. A proper balance of shear stability, low temperature stability, and thickening efficiency are obtained when such VI improvers are employed. Since polymerized acrylic acid ester VI improvers are obtained as viscous concentrates of the polymethacrylate copolymer in a hydrocarbon diluent, typically a solvent-refined neutral carrier oil, the flashpoint of the diluent must be such so as not to significantly lower the flashpoint of the formulated hydraulic fluid. Generally, the minimum flashpoint of the VI improver will be 320° F.

The polymethacrylate VI improvers employed for the present invention must be capable of developing a viscosity index in the formulated hydraulic fluid of 210 or greater and surpassing the requirements for shear stability of MIL-H-5606. Furthermore, the VI improver should not destroy the homogeneity of the formulation at −65° F. or cause the fluid to gel or freeze at −65° F. Preferably, the viscosity of the formulated hydraulic fluid will remain within acceptable limits even when the fluid is allowed to stand at −65° F. for a period of time up to about 3 hours.

In addition to meeting the above criteria, polymethacrylate copolymer viscosity index improvers useful for the preparation of the improved hydraulic fluids of this invention have specific gravities in the range 9.2–9.4 and maximum 210° F. viscosity of about 900 centistokes. Acryloid ®1019 (manufactured by the Rohm and Haas Company) and Texaco TC-10124 (manufactured by the Texaco Chemical Company) are illustrative viscosity index improvers of the above types which can be employed with the 2 centistoke synthetic hydrocarbons and synthetic ester(s) to provide highly useful hydraulic fluids. The VI improver will generally be employed in an amount from 5 to 20 weight percent, based on the total formulation. Especially advantageous formulations are obtained using from 6 to 12 percent of the polymethacrylate VI improver.

Fluids obtained using the above-defined synthetic hydrocarbons, esters and viscosity index improvers in the prescribed amounts will have typical specifications as follows:

| Viscosity (ASTM D445) | |
|---|---|
| −65° F. (centistokes) | 3000 (maximum) |
| 210° F. (centistokes) | 3.45 (minimum) |
| Viscosity Index | 210 (minimum) |
| Flash Point (°F.) (ASTM D93) | 320 (minimum) |
| Fire Point (°F.) (ASTM D92) | 345 (minimum) |
| Autoignition Temperature (°F.) (ASTM E659) | 600 (minimum) |
| Pour Point (°F.) (ASTM D97) | −70 (maximum) |
| Acid Number (ASTM D664) | 1 (maximum) |

In addition to the 2 centistoke alpha-olefin oligomers, the synthetic ester and viscosity index improver, which are essential components for the compositions of this invention, one or more other conventional additives may be employed for the formulation of the finished hydraulic fluids. Such additives can be employed in an amount from 0.1 to 3 weight percent and more usually are present from about 0.5 to 2 weight percent. Cumulatively, these additives typically do not exceed about 8 percent by weight of the total formulation. Such known additives include anti-oxidants, antiwear/EP agents, corrosion inhibitors, foam inhibitors, and the like.

Oxidation inhibitors which can be employed include the phenolic antioxidants derived from t-butylphenol, such as 4,4′-methylenebis(2,6-di-t-butylphenol), 2,6-di-t-butyl-N,N-dimethylamino-p-cresol, and thiodiethylenebis(3,5-di-t-butyl-4-hydroxy)hydrocinnamate, and the like; arylamines including N,N′-diphenyl phenylenediamine; diphenyl amines such as p-octyldiphenyl amine, p,p′-dioctyldiphenyl amine and the like, N-phenylnaphthylamines such as N-phenyl-1-naphthylamine, N-phenyl-2-naphthylamine, N-(p-dodecylphenyl)-2-naphthlamine and the like; dinaphthylamines such as di-1-naphthylamine, di-2-naphthylamine and the like; phenothiazines such as N-alkyl phenothiazine; dithiocarbamate derivatives; etc.

Illustrative antiwear/EP agents include various organophosphorous derivatives such as triphenyl phosphate, trinaphthyl phosphate, tricresyl phosphate, diphenyl cresyl or dicresyl phenyl phosphate, naphthyl diphenyl phosphate, triphenyl phosphorothionate and the like. Dithiocarbamate derivatives may also enhance the antiwear/EP properties.

Corrosion inhibitors and metal passivators which are useful include benzotriazole derivatives, such a tolyltriazole, benzoquanamine, aminoindazole and the like. A small amount of silicone oil or other materials known to suppress foaming may also be present in the formulation. Several parts per million dye, such as Oil Red 235 (manufactured by Passaic Color and Chemical Company) may also be included. Such dyes are specifically called for in MIL-H-5606 and MIL-H-83282 fluids.

The following examples illustrate the invention more fully but are not intended as a limit on the scope thereof. In the examples, all parts and percentages are given on a weight basis unless otherwise indicated.

EXAMPLE I

A lubricant composition was prepared utilizing a 2 centistoke synthetic hydrocarbon oil obtained from the oligomerization of 1-decene. The synthetic oil contained 98.0 percent dimer and had 210° F. and −65° F. viscosities of 1.66 centistokes and 1350 centistokes, respectively. To prepare the hydraulic fluid, 65 parts of the synthetic hydrocarbon oil was combined with 25 parts di-2-ethylhexyl adipate (210° F. viscosity 2.34 centistokes; −65° F. viscosity 4740 centistokes) and 10 parts polymethacrylate viscosity index improver (Acryloid ® 1019; weight average molecular weight 55,600; intrinsic viscosity 0.0557). The resulting blend had a 210° F. viscosity of 3.51 centistokes, 100° F. viscosity of 11.47 centistokes, −65° F. viscosity of 2200 centistokes and viscosity index of 226. The blend was a useful lubricant and when formulated with conventional additives provided highly useful hydraulic fluids having low temperature properties comparable to MIL-H-5606 fluids but with significantly improved fire resistance.

A similarly useful product is obtained when di-2-ethylhexyl azelate is blended with the synthetic hydrocarbon and polymethacrylate viscosity index improver. Due to the higher viscosity of the di-2-ethylhexyl azelate, the amount of viscosity index improver required to achieve approximately the same viscosity characteristics is only 9.2 parts.

To demonstrate the criticality of the VI improver, when 10 parts of a commercial polymethacrylate VI improver having a weight average molecular weight of 22,998 and intrinsic viscosity of 0.0230 was blended with 65 parts synthetic hydrocarbon and 25 parts di-2-ethylhexyl adipate, even though the low temperature properties of the resulting fluid were acceptable (−65° F. viscosity 1799 centistokes), the 210° F. viscosity was only 2.84 and the viscosity index only 173. By increasing the amount of VI improver it is possible to meet the minimum 210° F. viscosity specification, however, the −65° F. viscosity will then exceed the 3000 centistoke maximum specified for these hydraulic fluids.

EXAMPLE II

To demonstrate the ability to formulate the products of this invention with conventional additives to obtain finished hydraulic fluids, the following formulation was prepared:

| | Percentage |
|---|---|
| Synthetic Hydrocarbon Oil (2 cSt) | 63.04 |
| Di-2-ethylhexyl Adipate | 24.25 |
| Polymethacrylate Viscosity Index Improver | 9.7 |
| 4,4'-Methylenebis(2,6-di-t-butylphenol) | 2.0 |
| Tricresyl Phosphate | 1.0 |
| Oil Red 235 Dye | 0.01 |

The formulated fluid had a low temperature (−65° F.) viscosity superior to MIL-H-5606 fluids and exhibited enhanced fire resistance—comparable to MIL-H-83282 fluids—as evident from the following data:

| | |
|---|---|
| Viscosity (ASTM D445) | |
| 210° F. (centistokes) | 3.58 |
| 100° F. (centistokes) | 12.11 |
| −40° F. (centistokes) | 717 |
| −65° F. (centistokes) | 2880 |
| Viscosity Index (ASTM D2270) | 214 |
| Flash Point (°F.) (ASTM D93) | 330 |
| Fire Point (°F.) (ASTM D92) | 365 |
| Pour Point (°F.) (ASTM D97) | <−90 |
| Foam (ASTM D892) | 45,0 |
| Acid Number (ASTM D664) | 0.07 |

Performance capabilities of the formulated hydraulic fluid were evaluated using the Four-Ball Wear Test (ASTM D2266) with only 0.60 mm. wear obtained under 40 Kg load. The fluid was also tested for oxidation—corrosion at 275° F. using FED-STD-791 Method No. 5308 with the following results:

| | |
|---|---|
| Change in 100° F. viscosity (%) | +6.9 |
| Change in acid number | +0.30 |
| Change in metal weight: (mg/cm$^2$) | |
| Cd | +0.01 |
| Mg | +0.01 |
| Steel | −0.02 |
| Al | +0.02 |
| Cu | −0.07 |

EXAMPLE III

In a manner similar to that described in Example I, a lubricant composition suitable for use as a hydraulic fluid was prepared by blending 43 parts of the 2 centistoke synthetic hydrocarbon oil, 10 parts of the polymethacrylate viscosity index improver, and 45 parts isodecyl pelargonate (−65° F. viscosity 760 centistokes; 210° F. viscosity 1.76 centistokes). The resulting fluid had the following properties:

| | |
|---|---|
| Viscosity: | |
| 210° F. (centistokes) | 3.52 |
| 100° F. (centistokes) | 11.25 |
| −65° F. (centistokes) | 1867 |
| Viscosity Index | 238 |

The blend was formulated in accordance with Example II to provide a highly useful hydraulic fluid.

EXAMPLE IV

To demonstrate the use of different esters and VI improvers and the ability to vary the ratio of the components, the following formulations were prepared:

| | Product | | |
|---|---|---|---|
| | A | B | C |
| 2 Centistoke Synthetic Hydrocarbon | 66.4 | 46.5 | 45.5 |
| Di-2-ethylhexyl Adipate | 25.6 | — | — |
| Isodecyl Pelargonate | — | 45.5 | — |
| 2-Ethylhexyl Pelargonate | — | — | 44.5 |
| Polymethacrylate VI Improver* | 8.0 | 8.0 | 10.0 |
| Properties: | | | |
| 210° F. Viscosity (centistokes) | 3.58 | 3.46 | 3.56 |
| 100° F. Viscosity (centistokes) | 10.75 | 10.0 | 9.75 |
| −65° F. Viscosity (centistokes) | 2180 | 1435 | 1047 |
| Viscosity Index | 255 | 271 | 300 |

*Texaco TC-10124; weight average molecular weight 50,476; intrinsic viscosity 0.0505

All of the above blends provided effective hydraulic fluids when combined with conventional additives. For example, when Product C was formulated with 1 percent thiodiethylenebis(3,5-di-t-butyl-4-hydroxy) hydrocinnamate, 1 percent tricresyl phosphate and 0.01 percent Oil Red 235, a useful hydraulic fluid having the following characteristics was obtained:

| | |
|---|---|
| 210° F. Viscosity (centistokes) | 3.56 |
| −65° F. Viscosity (centistokes) | 1850 |
| Flash Point | 320° F. |
| Fire Point | 345° F. |
| Viscosity Index | 269 |

EXAMPLE V

To demonstrate the criticality of the ester component for the hydraulic formulations of the present invention, four basestocks containing 70 percent 2 centistoke synthetic hydrocarbon and 30 percent synthetic ester were prepared. Thirty weight percent was about the minimum level of ester necessary to obtain the prescribed rubber swell characteristics in the basestock. Each basestock was prepared using a different synthetic diester lubricant. Diesters employed were ditridecyl adipate (−65° F. viscosity >24,000 centistokes; 210° F. viscosity 5.5 centistokes), diisodecyl adipate (−65° F. viscosity 23,411 centistokes; 210° F. viscosity 3.55 centistokes), diisodecyl azelate (−65° F. viscosity 24,000 centistokes; 210° F. viscosity 4.35 centistokes) and di-2-ethylhexyl azelate (−65° F. viscosity 6600 centistokes; 210° F. viscosity 2.96 centistokes). Polymethacrylate viscosity index improver (weight average molecular weight 50,476; intrinsic viscosity 0.0505) was added to each basestock until the minimum viscosity at 210° F. (3.45 centistokes) was reached. Weight percentages of the various components in the final blend, all of which had flash points ≧320° F., and viscosity characteristics of the resulting formulations were as follows:

| | Product | | | |
|---|---|---|---|---|
| | A | B | C | D |
| Two Centistoke Synthetic Hydrocarbon | 66.50 | 65.52 | 66.01 | 65.31 |
| Ditridecyl Adipate | 28.50 | — | — | — |
| Diisodecyl Adipate | — | 28.08 | — | — |
| Diisodecyl Azelate | — | — | 28.29 | — |
| Di-2-ethylhexyl Azelate | — | — | — | 27.99 |
| Viscosity Index Improver | 5.00 | 6.40 | 5.70 | 6.70 |
| −65° F. Viscosity (Centistokes) | 4292 | 3077 | 3148 | 2449 |
| Viscosity Index | 199 | 223 | 219 | 229 |

It is apparent from the above data that it is only possible to obtain the prescribed balance of properties, i.e., −65° F. and 210° F. viscosities and flash point, with the di-2-ethylhexyl azelate (Formulation D). When similar diesters which are commonly used as synthetic lubricants but which do not meet the necessary viscosity criteria are employed with the 2 centistoke synthetic hydrocarbon and viscosity improver, it is not possible to obtain hydraulic fluids meeting all of the specifications of the present invention. It will be evident to those skilled in the art, that if the amount of VI improver in Formulations A–C is varied so that the −65° F. viscosity is met, the 210° F. viscosity would then be substantially below the specified minimum.

We claim:

1. An improved low temperature, fire resistant hydraulic fluid having a 210° F. viscosity ≧3.45 centistokes, −65° F. viscosity <3000 and flashpoint ≧320° F. comprising (a) 30 to 90 percent by weight of a synthetic hydrocarbon obtained by the oligomerization of a $C_{6-12}$ alpha-olefin or alpha-olefin mixture and having a 210° F. viscosity of 1.6 to 2.2 centistokes;

(b) 5 to 50 percent by weight of a monoester or diester containing from 13 to 30 carbon atoms and having a 210° F. viscosity of ≧3.5 centistokes and −65° F. viscosity of <8000 centistokes, said monoester derived from a $C_{6-17}$ aliphatic monocarboxylic acid and aliphatic branched-chain alcohol having from 8 to 12 carbon atoms and said diester derived from a $C_{6-9}$ aliphatic dicarboxylic acid and aliphatic branched-chain alcohol having from 6 to 10 carbon atoms; and (c) 5 to 20 percent by weight of a polymethacrylate viscosity index improver having a weight average molecular weight in the range 40,000 to 65,000 and intrinsic viscosity of 0.040 to 0.065.

2. The hydraulic fluid of claim 1 wherein the synthetic hydrocarbon is derived from an alpha-olefin containing at least 75 percent by weight 1-decene and contains less than 10 percent trimer and higher oligomers.

3. The hydraulic fluid of claim 2 wherein the synthetic hydrocarbon is present in an amount from 40 to 75 percent by weight and the viscosity index improver is present from about 6 to 12 percent by weight.

4. The hydraulic fluid of claim 3 wherein the ester is di-2-ethylhexyl adipate or di-2-ethylhexyl azelate present in an amount from 20 to 30 percent by weight.

5. The hydraulic fluid of claim 3 wherein the ester is 2-ethylhexyl pelargonate or isodecyl pelargonate present in an amount from 40 to 50 percent by weight.

6. The hydraulic fluid of claim 3 wherein the polymethacrylate viscosity index improver has a weight average molecular weight of 45,000 to 60,000 and intrinsic viscosity of 0.045 to 0.060.

7. The hydraulic fluid of claim 3 which additionally contains 0.5 to 2 weight percent phenolic antioxidant and 0.5 to 2 weight percent organophosphorous antiwear/EP agent.

8. The hydraulic fluid of claim 7 wherein the phenolic antioxidant is 4,4'-methylenebis(2,6-di-t-butylphenol) or thiodiethylenebis(3,5-di-t-butyl-4-hydroxy)hydrocinnamate and the organophosphorous antiwear/EP agent is tricresyl phosphate.

9. The hydraulic fluid of claim 8 which additionally contains up to several parts per million dye.

* * * * *